US008398168B2

(12) United States Patent
Lawson

(10) Patent No.: US 8,398,168 B2
(45) **Date of Patent: *Mar. 19, 2013**

(54) POWERED GLIDER RECLINER LINKAGE MECHANISM

(75) Inventor: Gregory M. Lawson, Tupelo, MS (US)

(73) Assignee: L & P Property Management Company, South Gate, CA (US)

( * ) Notice: Subject to any disclaimer, the term of this patent is extended or adjusted under 35 U.S.C. 154(b) by 96 days.

This patent is subject to a terminal disclaimer.

(21) Appl. No.: 12/870,498

(22) Filed: Aug. 27, 2010

(65) Prior Publication Data

US 2011/0175426 A1 Jul. 21, 2011

Related U.S. Application Data

(60) Provisional application No. 61/295,554, filed on Jan. 15, 2010.

(51) Int. Cl.
*A47C 1/031* (2006.01)

(52) U.S. Cl. ..... 297/259.2; 297/85 M; 297/68

(58) Field of Classification Search ..... 297/85 M, 297/88, 271.1, 260.2, 68, 75, 259.2
See application file for complete search history.

(56) References Cited

U.S. PATENT DOCUMENTS

| | | | | |
|---|---|---|---|---|
| 3,300,243 | A * | 1/1967 | Mizelle | 297/85 R |
| 4,244,620 | A | 1/1981 | Harrison et al. | |
| 5,072,988 | A * | 12/1991 | Plunk | 297/68 |
| 5,088,473 | A | 2/1992 | Chen | |
| 5,765,913 | A * | 6/1998 | LaPointe et al. | 297/281 |
| 6,000,758 | A | 12/1999 | Schaffner et al. | |
| 6,120,095 | A | 9/2000 | Rogers | |
| 7,543,885 | B2 | 6/2009 | Pollard et al. | |
| 7,997,644 | B2 | 8/2011 | Hoffman et al. | |
| 8,016,348 | B2 | 9/2011 | Hoffman et al. | |
| 8,113,574 | B2 | 2/2012 | Hoffman et al. | |
| 2004/0051350 | A1 * | 3/2004 | Duncan et al. | 297/68 |
| 2006/0273631 | A1 * | 12/2006 | White et al. | 297/85 |
| 2009/0096255 | A1 * | 4/2009 | Robertson | 297/85 |
| 2009/0278395 | A1 | 11/2009 | Pollard et al. | |
| 2012/0153704 | A1 | 6/2012 | Hoffman et al. | |

OTHER PUBLICATIONS

International Search Report from PCT/US 11/20387 dated Mar. 23, 2011.

Nonfinal Office Action in U.S. Appl. No. 12/981,176 mailed Jul. 24, 2012, 25 pages.

* cited by examiner

*Primary Examiner* — David Dunn
*Assistant Examiner* — Erika Garrett
(74) *Attorney, Agent, or Firm* — Shook Hardy & Bacon L.L.P.

(57) ABSTRACT

A glider-recliner-style seating unit (glider recliner) that includes a linkage mechanism adapted to move the glider recliner between closed, extended, and reclined positions is provided. The glider recliner is powered by a linear actuator that facilitates automated adjustment of the linkage mechanism. This adjustment of the linear actuator is sequenced into a first phase and a second phase. A stroke of the linear actuator in the first phase acts to adjust the linkage mechanism between the closed and extended positions by extending or retracting ottoman(s) attached to a footrest assembly. A stroke in the second phase acts to adjust the linkage mechanism between the extended and reclined positions by translating a seat-mounting plate forward or rearward at a consistent inclination angle while, concurrently, tilting a back-mounting link. Accordingly, the phase sequencing ensures that the linkage mechanism commences adjustment within the second phase only once the first-phase adjustment is substantially complete.

19 Claims, 8 Drawing Sheets

POWERED GLIDER RECLINER LINKAGE MECHANISM

CROSS-REFERENCE TO RELATED APPLICATIONS

This application claims the benefit of U.S. Provisional Application No. 61/295,554, filed Jan. 15, 2010, entitled "POWERED GLIDER RECLINER LINKAGE MECHANISM," herein incorporated by reference.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a seating unit that acts as a glider recliner. Accordingly, the improved linkage mechanism of the present invention provides for reclining the seating unit while accommodating operation of a glide assembly.

Reclining seating units exist that allow a user to forwardly extend a footrest or ottoman and to recline a backrest relative to a seat. These existing seating units typically provide three basic positions: a standard, non-reclined closed position; an extended position; and a reclined position. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward of the seat, and the backrest remains sufficiently upright to permit comfortable television viewing by an occupant of the seating unit. In the reclined position the backrest is positioned rearward from the extended position into an obtuse relationship with the seat for lounging or sleeping.

Several modern glider recliners presently in the industry are adapted to provide the adjustment capability described above. However, these glider recliners require relatively complex linkage mechanisms to afford this capability. The complex linkage assemblies limit certain design aspects utilized by furniture manufacturers, such as incorporation of a motor to provide powered adjustment. In particular, these present glider-recliner linkage assemblies impose constraints on attaching a motor that can achieve full adjustment between the three positions above without interfering with internal crossbeams or limiting movement of the glide assembly. Accordingly, the present invention introduces a novel linkage mechanism that allows a glider-recliner-style seating unit to provide the features of full powered adjustment between the three positions above without interfering with crossbeams or the operation of the glide assembly.

BRIEF SUMMARY OF THE INVENTION

Embodiments of the present invention seek to provide a simplified, compact, linkage mechanism which can fully adjust a glider-recliner-type seating unit (hereinafter "glider recliner") between three positions (closed, extended, and reclined) without limiting movement of a glide assembly, where the glide assembly allows a seat of the glider recliner to oscillate forward and backward with respect to the base. Generally, the glider recliner is powered by a linear actuator that assists adjustment of a linkage mechanism. Movement of the linear actuator is sequenced into a first phase and a second phase, where the second phase occurs once the first phase is substantially complete. In other words, a stroke of the first phase is carried out substantially independently of a stroke of the second phase. In an exemplary embodiment, the first phase acts to adjust the linkage mechanism between the closed and extended positions, while the second phase acts to adjust the linkage mechanism between the extended and reclined positions. Accordingly, in operation, the sequencing ensures that a footrest is substantially extended before a backrest begins reclining.

In embodiments of the present invention, the simplified linkage mechanism discussed above can be assembled to a linear actuator reassembling a compact motor and that is adaptable to essentially any type of seating unit. In an exemplary embodiment, the compact motor in concert with the linkage mechanism can achieve full, sequenced, and automated adjustment of the glider recliner between each of the closed, extended, and reclined positions. Typically, the compact motor may be employed in a proficient and cost-effective manner to adjust the linkage mechanism without creating interference or other disadvantages appearing in the conventional designs that are inherent with automation.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
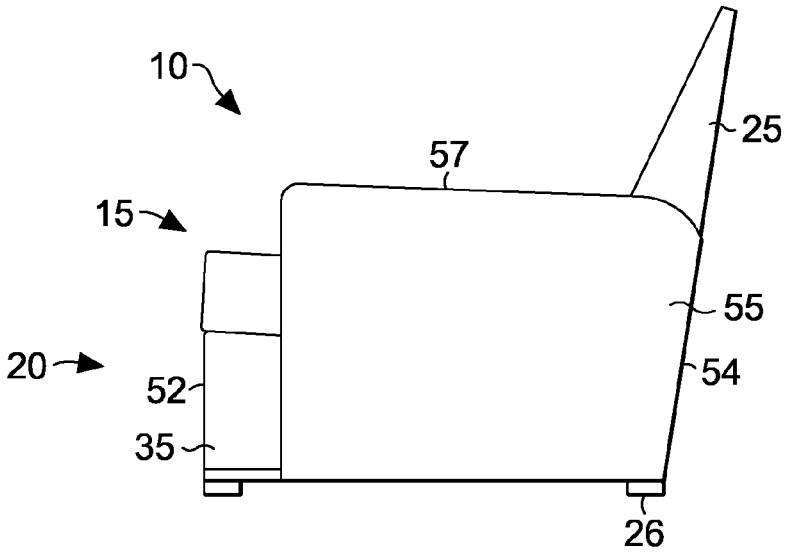
FIG. 1 is a diagrammatic lateral view of a seating unit in a closed position, in accordance with an embodiment of the present invention.
Figure 2:
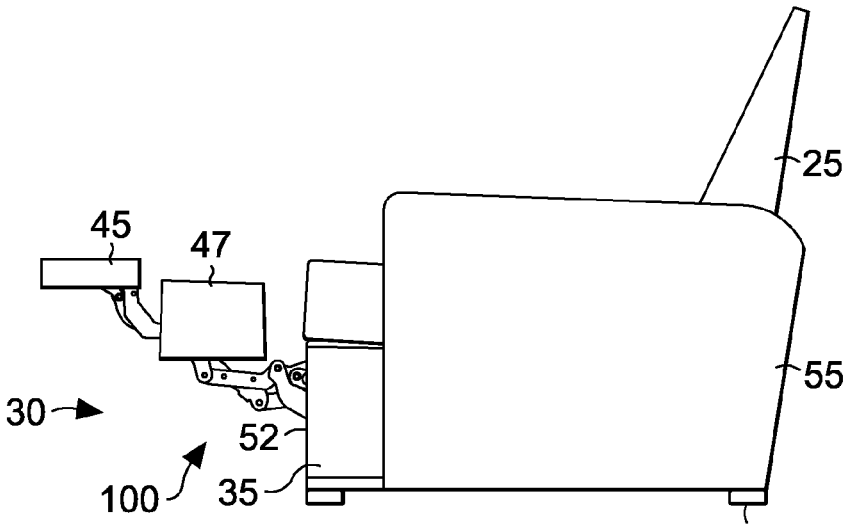
FIG. 2 is a view similar to FIG. 1, but in an extended position, in accordance with an embodiment of the present invention.
Figure 3:
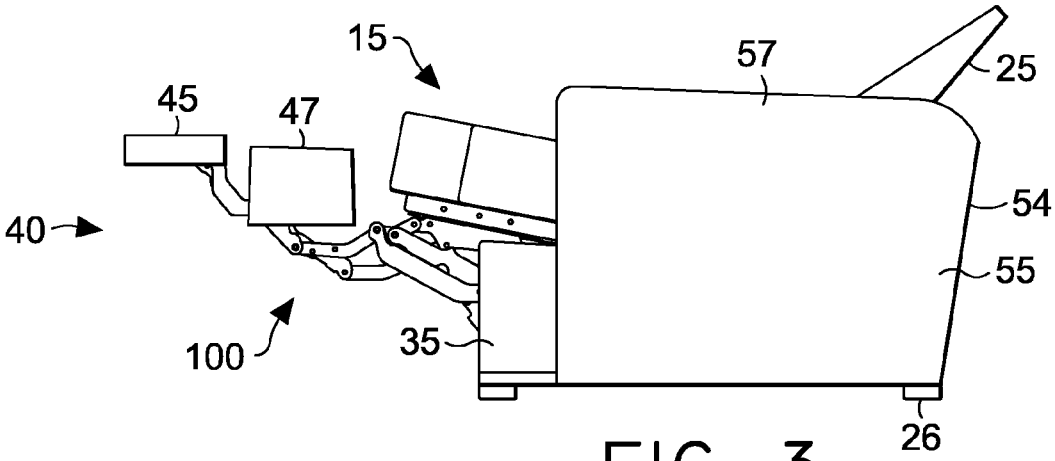
FIG. 3 is a view similar to FIG. 1, but in a reclined position, in accordance with an embodiment of the present invention.

FIGS. 1-3 illustrate a seating unit 10. Seating unit 10 has a seat 15, a backrest 25, legs 26 (e.g., support bushings), a linkage mechanism 100, a first foot-support ottoman 45, a second foot-support ottoman 47, a stationary base 35, and a pair of opposed arms 55. Stationary base 35 has a forward section 52, a rearward section 54, and is supported by the legs 26, where the legs 26 support the stationary base 35 and raise it above an underlying surface (not shown). In addition, the stationary base 35 is interconnected to the seat 15 via the linkage mechanism 100 that is generally disposed between the pair of opposed arms 55, and the rearward section 54. Seat 15 is moveable over the stationary base 35 during adjustment of the seating unit 10, or when oscillating a glide assembly of the linkage mechanism 100. In embodiments, the seat 15 or the backrest 25 is moveable according to the arrangement of the linkage mechanism 100 such that no portion of the seat 15 interferes with the opposed arms 55 throughout adjustment.

Opposed arms 55 are laterally spaced and have an arm-support surface 57 that is typically substantially horizontal. In one embodiment, the pair of opposed arms 55 are attached to the stationary base 35 via intervening members. The backrest 25 extends from the rearward section 54 of the stationary base 35 and is rotatably coupled to the linkage mechanism 100, typically proximate to the arm-support surface 57. First foot-support ottoman 45 and the second foot-support ottoman 47 are moveably supported by the linkage mechanism 100. The linkage mechanism 100 is arranged to articulably actuate and control movement of the seat 15, the back 25, and the ottomans 45 and 47 between the positions shown in FIGS. 1-3, as more fully described below.

As shown in FIGS. 1-3, the seating unit 10 is adjustable to three basic positions: a closed position 20, an extended position 30 (i.e., TV position), and the reclined position 40. FIG. 1 depicts the seating unit 10 adjusted to the closed position 20, which is a normal non-reclined sitting position with the seat 15 in a generally horizontal position and the backrest 25 generally upright and generally perpendicular to the seat 15. In particular, the seat 15 is disposed in a slightly inclined orientation relative to the stationary base 35. In this embodiment, the inclined orientation may be maintained throughout adjustment of the seating unit 10. In addition, when adjusted to the closed position 20, the ottomans 45 and 47 are positioned below the seat 15.

Turning to FIG. 2, the extended position 30, or TV position, will now be described. When the seating unit 10 is adjusted to the extended position 30, the first foot-support ottoman 45 and the second foot-support ottoman 47 are extended forward of the forward section 52 of the stationary base 35 and disposed generally horizontal. However, the backrest 25 remains substantially perpendicular to the seat 15 and will not encroach an adjacent wall. Also, the seat 15 is maintained in the inclined orientation relative to the stationary base 35. Typically, the seat 15 is translated slightly forward and upward relative stationary base 35. Thus, the configuration of the seating unit 10 in the extended position 30 provides an occupant an inclined TV position while providing space-saving utility. This independent movement of the seat 15 allows for a variety of styling to be incorporated into the seat 15, such as T-cushion styling.

FIG. 3 depicts the reclined position 40, in which the seating unit 10 is fully reclined. Typically, the opposed arms 55 are attached to the stationary base 35 and the legs 26 extend from the stationary base 35. The backrest 25 is rotated rearward by the linkage mechanism 100 and biased in a rearward inclination angle. The rearward inclination angle is typically an obtuse angle in relation to the seat 15. However, the rearward inclination angle of the backrest 25 is offset by a forward and upward translation of the seat 15 as controlled by the linkage mechanism 100. This is in contrast to other reclining chairs with 3-position mechanisms, which cause their backrest to move rearward during adjustment, thereby requiring that the reclining chair be positioned a considerable distance from an adjacent rear wall or other proximate fixed objects. Thus, the forward and upward translation of the seat 15 in embodiments of the present invention allow for zero-wall clearance. Generally, the "zero-wall clearance" is utilized herein to refer to space-saving utility that permits positioning the seating unit 10 in close proximity to an adjacent rear wall and other fixed objects. In embodiments of the reclined position 40, the ottomans 45 and 47 may be moved farther forward and upward from their position in the extended position 30.

Figure 4:
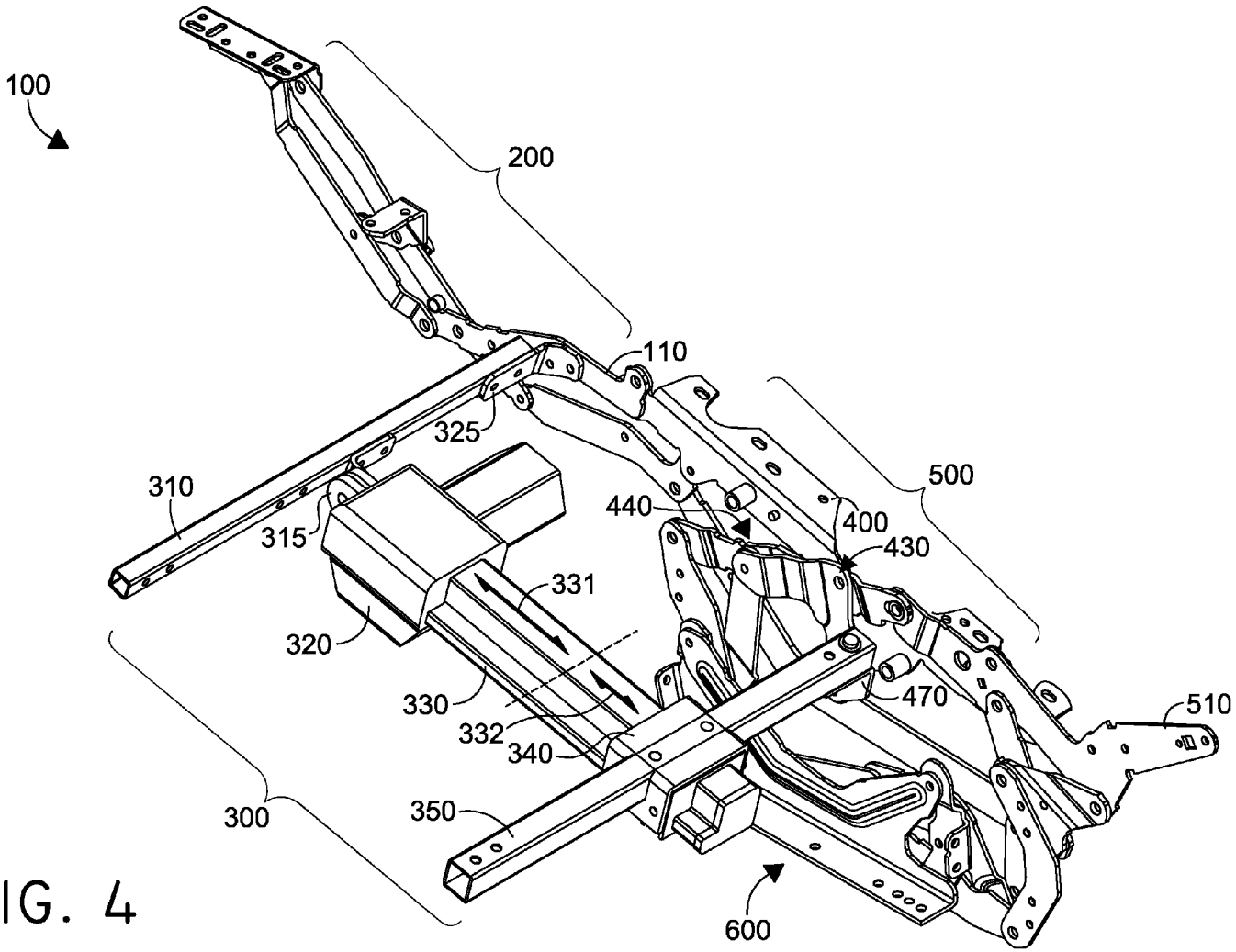
FIG. 4 is a perspective view of a linear actuator mounted to a linkage mechanism that is adjusted to a reclined position, in accordance with an embodiment of the present invention.
Figure 5:
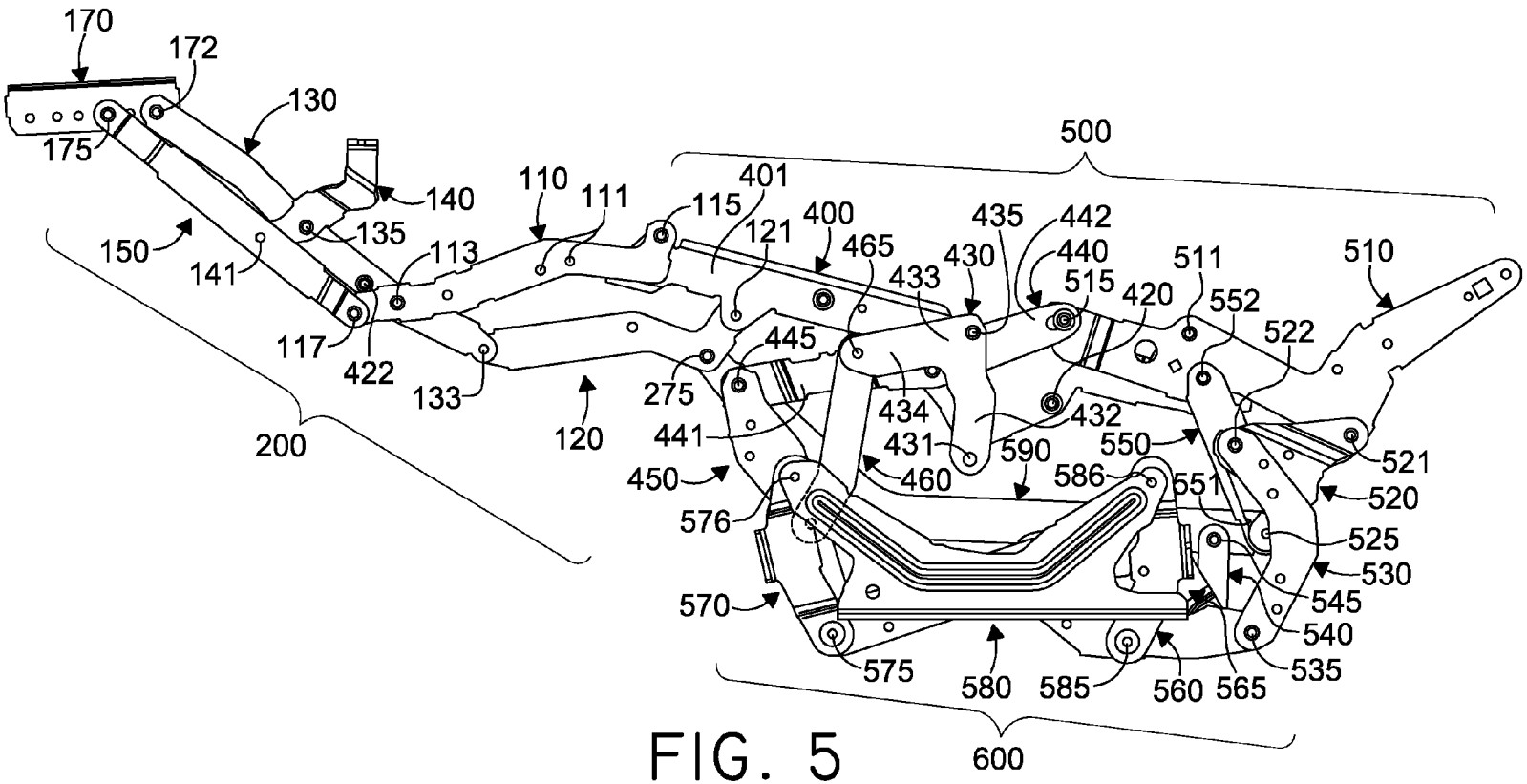
FIG. 5 is a diagrammatic lateral view, from an internal perspective, of the linkage mechanism in the reclined position, in accordance with an embodiment of the present invention.
Figure 6:
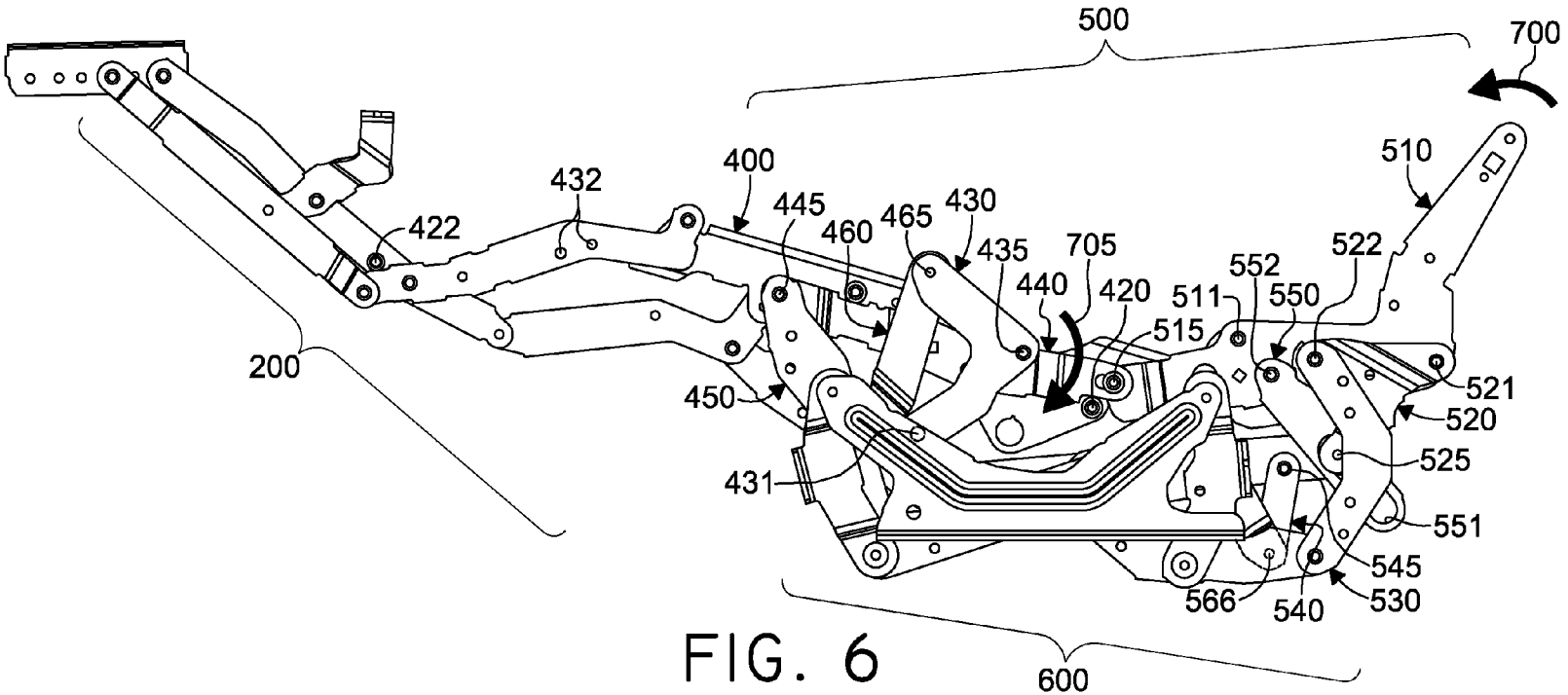
FIG. 6 is a view similar to FIG. 5, but in an extended position, in accordance with an embodiment of the present invention.
Figure 7:
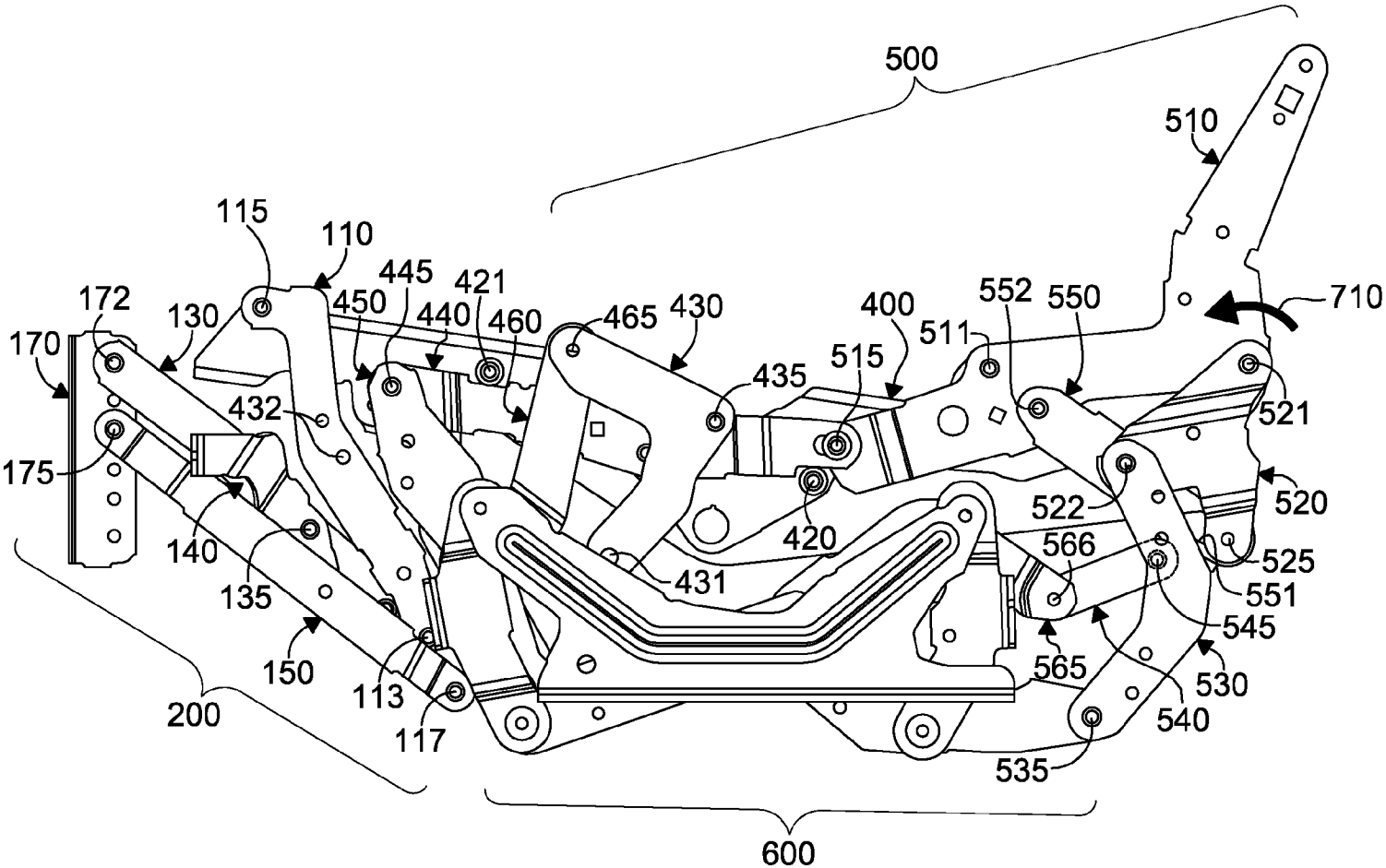
FIG. 7 is a view similar to FIG. 5, but in a closed position, in accordance with an embodiment of the present invention.

FIGS. 4-7 illustrate the exemplary configurations of a linkage mechanism 100 for a glider-recliner-type seating unit 10 (hereinafter "glider recliner) that is powered by a linear actuator included within a motor assembly 300. As discussed above, the linkage mechanism 100 is arranged to articulably actuate and control movement of a seat, a backrest, and ottoman(s) of the glider recliner when the linkage mechanism 100 is adjusted between the positions shown in FIGS. 5-7. That is, the linkage mechanism 100 is adjustable to three basic positions: reclined position (FIG. 5), an extended (TV) position (FIG. 6), and a closed position (FIG. 7). In the reclined position, as shown in FIG. 5, the backrest is rotated rearwardly by the linkage mechanism 100 and biased in a rearward inclination angle, which is an obtuse angle in relation to the seat. When the glider recliner is adjusted to the extended position, as shown in FIG. 6, the ottomans are extended forward and disposed generally horizontal, while the backrest remains substantially perpendicular to the seat. The closed position of FIG. 7 is a normal non-reclined sitting position with the seat in a generally horizontal position and the back generally upright and in a substantial, perpendicular-biased relation to the seat.

Further, the linkage mechanism 100 comprises a plurality of linkages that are arranged to actuate and control movement of the glider recliner during adjustment between the closed, the extended, and the reclined position. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

Generally, the linkage mechanism 100 guides the rotational movement of the backrest, the translation of the seat, and the extension of the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are typically disposed in opposing-facing relation about a longitudinally-extending plane that bisects the glider recliner between the pair of opposed arms. As such, the ensuing discussion will focus on only one of the linkage mechanisms 100, with the content being equally applied to the other, complimentary, linkage assembly.

With reference to FIG. 4, a perspective view of the linkage mechanism 100 in the reclined position is shown, in accordance with an embodiment of the present invention. In embodiments, the linkage mechanism 100 includes a footrest assembly 200, a seat-mounting plate 400, a seat-adjustment assembly 500, and a glide assembly 600. The footrest assembly 200 is comprised of a plurality of links arranged to extend and collapse the ottomans during adjustment of the glider recliner between the extended position and the closed position. The seat-mounting plate 400 is configured to fixedly mount to the seat of the glider recliner, and, in conjunction with an opposed seat-mounting plate, defines a seat support surface (not shown). Generally, the seat-adjustment assembly 500 is adapted to recline and incline the backrest of the glider recliner, which is coupled to the back-mounting link 510. Further, the seat-adjustment assembly 500 includes links (e.g., the motor bellcrank 430) that indirectly couple an activator bar 350 of a motor assembly 300 to the seat-mounting plate 400, thereby facilitating movement of the glider-recliner seat in response to actuation of a linear actuator within the motor assembly 300.

As mentioned previously, with reference to FIG. 4, the linkage mechanism 100 is coupled to the motor assembly 300, which provides powered adjustment of the linkage mechanism 100 between the reclined, the extended, and the closed positions. The motor assembly 300 includes a front motor tube 310, a front motor bracket 315, a motor mechanism 320, a front motor tube bracket 325, a track 330, a motor activator block 340, and an activator bar 350. The motor mechanism 320 and the motor activator block 340 are slidably connected via the track 330. This "linear actuator" comprised of the motor mechanism 320, the track 330, and the motor activator block 340 is held in position and coupled to the linkage mechanism 100 by way of the front motor tube 310 and the activator bar 350. Generally, the front motor tube 310 and the activator bar 350 span between and couple together the linkage mechanism 100 shown in FIG. 1 and its counterpart, minor-image linkage mechanism (not shown). In embodiments, the front motor tube 310 and the activator bar 350 function as a set of crossbeams and may be formed from square metal tubing. Alternatively, the seat-mounting plate 400 and the plurality of links that comprise the linkage mechanism 100 are typically formed from metal stock, such as stamped, formed steel. However, it should be understood and appreciated that any suitable rigid or sturdy material known in the furniture-manufacturing industry may be used in place of the materials described above.

The front motor tube 310 is attached to the linkage mechanism 100 via the front motor tube bracket 325, which is fixedly coupled to a front ottoman link 110 of the footrest assembly 200. The activator bar 350 includes a pair of opposed ends and is rotatably coupled to the seat-adjustment assembly 500 via a rear pivot link 520 to the motor bellcrank 430. The motor mechanism 320 is protected by a housing that is pivotably coupled to the front motor tube 310 via the front motor bracket 315. The motor activator block 340 is attached to the activator bar 350 between the opposed ends by way of fasteners.

In operation, the motor mechanism 320 and the motor activator block 340 cause the motor activator block 340 to longitudinally traverse, or slide, along the track 330. This sliding action produces a lateral force or thrust on the front motor tube 310 and the activator bar 350, which, in turn, generates movement of the linkage mechanism 100. As more fully discussed below, the sliding action of the motor activator block 340, or stroke of the linear actuator, is sequenced into a first phase and a second phase. In an exemplary embodiment, the first phase and second phase are mutually exclusive in stroke. In other words, the linear-actuator stroke of the first phase fully completes before the linear-actuator stroke of the second phase commences, and vice versa.

Initially, the track 330 is operably coupled to the motor mechanism 320 and includes a first travel section 331 and a second travel section 332. The motor activator block 340 translates longitudinally along the track 330 under automated control of the motor mechanism 320 such that the motor activator block 340 translates within the first travel section 331 during the first phase and the second travel section 332 during the second phase. As illustrated in FIG. 4, the dashed line separating the first travel section 331 and the second travel section 332 indicates that the travel sections 331 and 332 abut, however, they do not overlap. It should be realized that the precise length of the travel sections 331 and 332 is provided for demonstrative purposes only, and that the length of the travel sections 331 and 332, or ratio of the linear-actuator stroke allocated to each of the first phase and second phase, may vary from the length or ratio depicted.

Generally, the first phase involves longitudinal translation of the motor activator block 340 along the first travel section 331 of the track 330 that creates a lateral thrust at the front motor tube 310. The lateral thrust invokes movement of the front ottoman link 110. The movement of the front ottoman link 110 invokes and controls adjustment of the footrest assembly 200 between the closed position and the extended position. Further, during the first phase, the motor mechanism 320 moves forward and upward with respect to the glide assembly 600 while the motor activator block 340 remains generally fixed in space, thereby extending the footrest assembly 200 from the closed position to the extended position. Once a stroke of the first phase is substantially complete, the second phase occurs.

Figure 9:
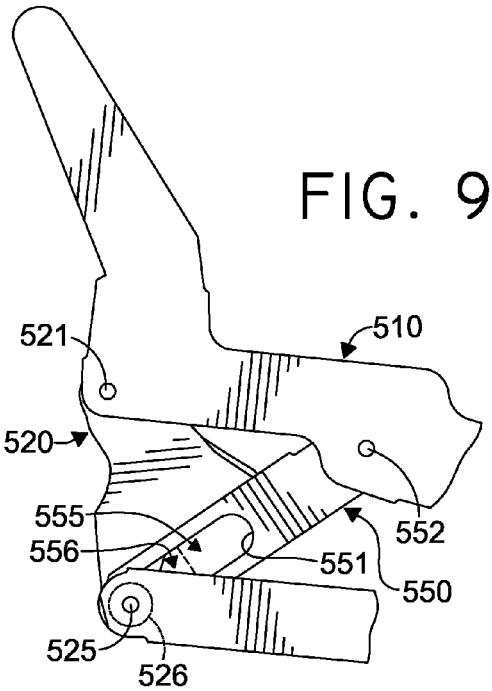
FIG. 9 is a partial side-elevation view of the linkage mechanism in the closed position highlighting a sequence link, in accordance with an embodiment of the present invention.
Figure 10:
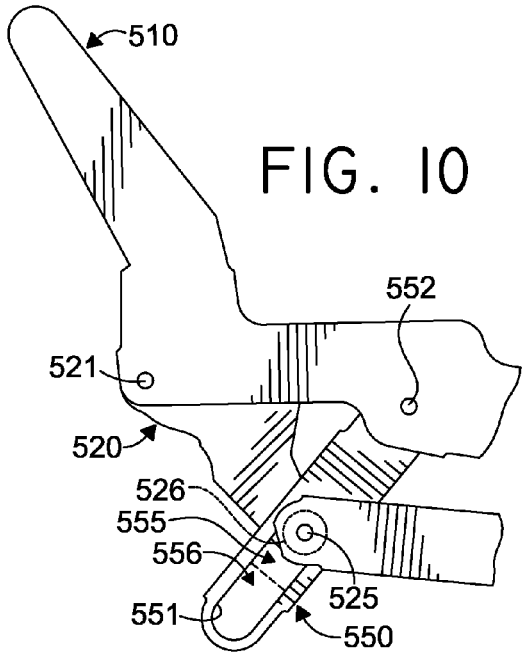
FIG. 10 is a view similar to FIG. 9, but in the extended position, in accordance with an embodiment of the present invention.
Figure 11:
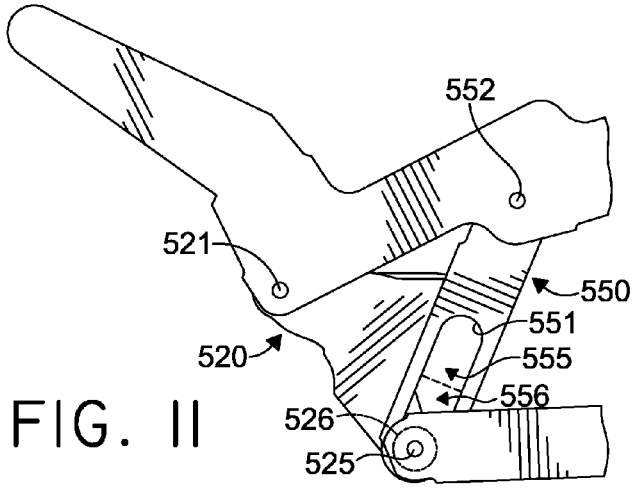
FIG. 11 is a view similar to FIG. 9, but in the reclined position, in accordance with an embodiment of the present invention.

Generally, the second phase involves longitudinal translation of the motor activator block 340 along the second travel section 332 of the track 330 that creates a lateral thrust at the activator bar 350. The lateral thrust invokes movement of the motor bellcrank 430. The movement of the motor bellcrank 430 invokes and controls adjustment of the seat-adjustment assembly 500 between the extended position and the reclined position. Further, during the second phase, the motor activator block 340 moves rearward with respect to the glide assembly 600 while the motor mechanism 320 remains generally fixed in space, thereby adjusting the seat-adjustment assembly 500 from the extended position to the reclined position. In embodiments, a weight of an occupant seated in the glider recliner and/or springs interconnecting links of the seat-adjustment assembly 500 may assist in creating the sequence. Accordingly, the sequence ensures that adjustment of the footrest between the closed and extended positions is not interrupted by an adjustment of the backrest, and vice versa. In other embodiments, as depicted in FIGS. 9-11, a sequencing assembly integrated within the linkage mechanism 100 is provided to control the adjustment of the glider recliner.

In one instance, the combination of the motor mechanism 320, the track 330, and the motor activator block 340 is embodied as an electrically powered linear actuator. In this instance, the linear actuator is controlled by a hand-operated controller that provides instructions to the linear actuator. These instructions may be provided upon detecting a user-initiated actuation of the hand-operated controller. Further, these instructions may cause the linear actuator to carry out a complete first phase and/or second phase of movement. Or, the instructions may cause the linear actuator to partially complete the first phase or the second phase of movement. As such, the linear actuator may be capable of being moved to and maintained at various positions within a stroke of the first phase or the second phase, in an independent manner.

Although a particular configuration of the combination of the motor mechanism 320, the track 330, and the motor activator block 340 has been described, it should be understood and appreciated that other types of suitable devices that provide sequenced adjustment may be used, and that embodiments of the present invention are not limited to a linear actuator as described herein. For instance, the combination of the motor mechanism 320, the track 330, and the motor activator block 340 may be embodied as a telescoping apparatus that extends and retracts in a sequenced manner.

Figure 8:
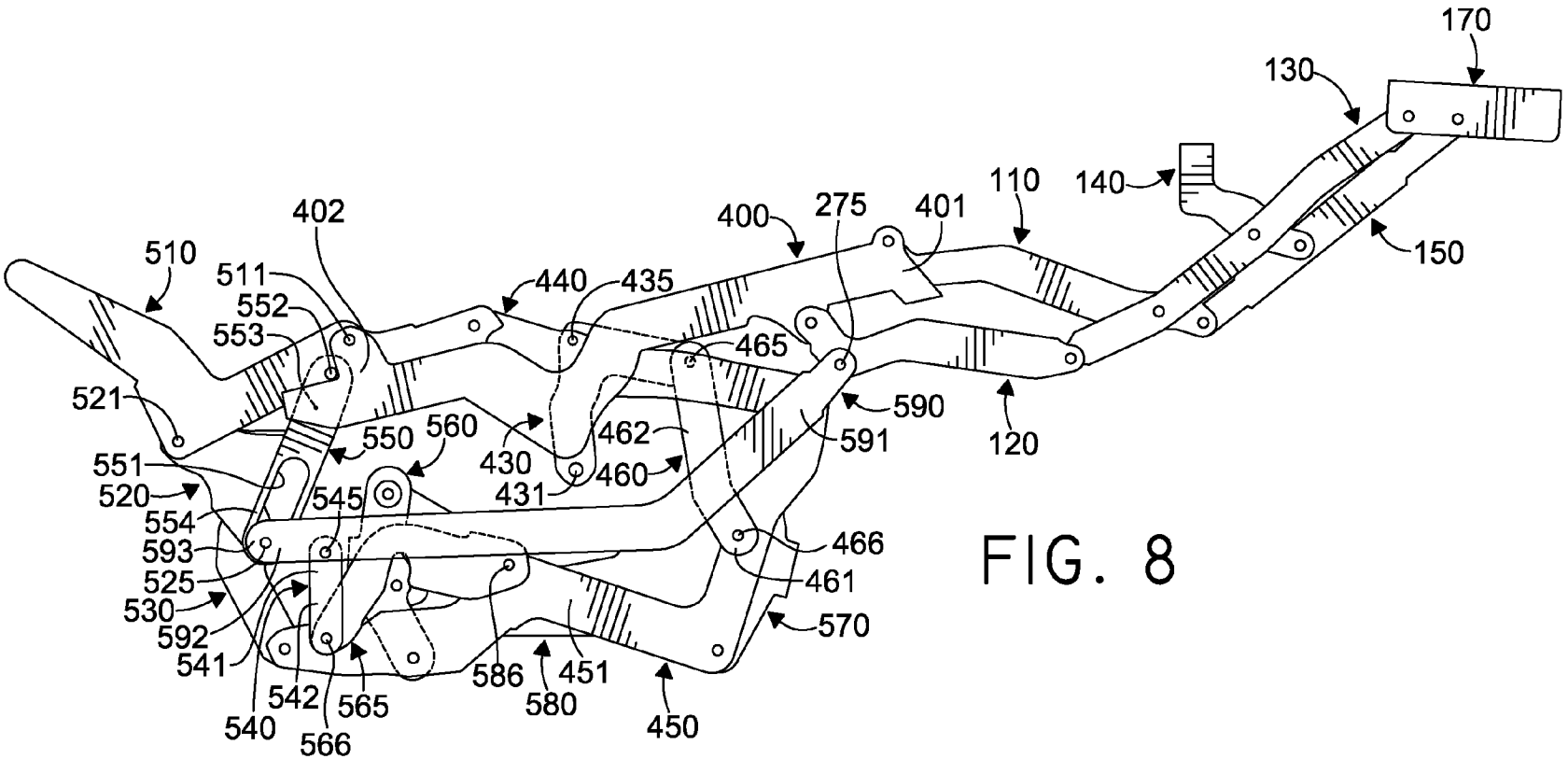
FIG. 8 is a diagrammatic lateral view, from an external perspective, of the linkage mechanism in the reclined position, in accordance with an embodiment of the present invention.

Turning now to FIG. 5, the components of the linkage mechanism 100 will now be discussed in detail. As discussed above, the linkage mechanism 100 includes the footrest assembly 200, the seat-mounting plate 400, the seat-adjustment assembly 500, and the glide assembly 600. The footrest assembly 200 includes the front ottoman link 110, a rear ottoman link 120, an outer ottoman link 130, a mid-ottoman bracket 140, an inner ottoman link 150, and a footrest bracket 170. Front ottoman link 110 is rotatably coupled to a forward portion 401 of the seat-mounting plate 400 at pivot 115. The front ottoman link 110 is also pivotably coupled to the outer ottoman link 130 at pivot 113 and the inner ottoman link 150 at pivot 117. Further, the front ottoman link 110 is attached to the front motor tube 310 via the front motor tube bracket 325 mounted at location 111. The rear ottoman link 120 is rotatably coupled to the forward portion of the seat-mounting plate 400 at pivot 121 and pivotably coupled to the outer ottoman link 130 at pivot 133. Further, as shown in FIG. 8, the rear ottoman link 120 is pivotably coupled to a forward portion 591 of the footrest drive link 590, of the seat-adjustment assembly 500, at pivot 275. During adjustment in the first phase (i.e., adjustment between the closed and extended positions), directional force transferred by the linear actuator to the front ottoman link 110 causes the footrest assembly 200 to push out to the extended position or to collapse to the closed position. This movement of the footrest assembly 200, and specifically of the rear ottoman link 120, within the first phase invokes translation of the footrest drive link 590. The translation of the footrest drive link 590, in turn, shifts a sequence element 526 within a guide slot 551 of a sequence link 550 between a first region 555 and a second region 556, as described more fully below, with reference to FIGS. 9-17.

The outer ottoman link 130 is pivotably coupled on one end to the rear ottoman link 120 at the pivot 133 and the front ottoman link 110 at the pivot 113. At an opposite end, the outer ottoman link 130 is pivotably coupled to the footrest bracket 170 at pivot 172. Between the ends of the outer ottoman link 130, the mid-ottoman bracket 140 is pivotably coupled thereto at pivot 135. The mid-ottoman bracket 140 is also pivotably coupled to the inner ottoman link 150 at pivot 141. The inner ottoman link 150 is further pivotably coupled to the front ottoman link 110 at the pivot 117 and to the footrest bracket 170 at pivot 175. In embodiments, the footrest bracket 170 and the mid-ottoman bracket 140 are designed to attach to ottomans, such as the first foot-support ottoman 45 and the second foot-support ottoman 47, respectively. In a specific instance, as shown in FIGS. 2 and 5, the footrest bracket 170 and the mid-ottoman bracket 140 support respective ottomans in a substantially horizontal disposition when the footrest assembly 200 is fully extended upon completion of the first phase of adjustment.

With reference to FIG. 5, the glide assembly 600 of the linkage mechanism 100 will now be described. Typically, the glide assembly 600 serves to provide vertical support for a remainder of the linkage mechanism 100. The glide assembly 600 includes a glide bracket 580 (see FIG. 2) that is fixedly mounted to a chassis that raises the linkage mechanism 100 above an underlying surface (not shown). The glide assembly 600 also includes a carrier link 450 that is coupled to the footrest assembly 200 and the seat-adjustment assembly 500.

Generally, the carrier link 450 is configured to swing, oscillate, or glide both forward and backward with respect to the stationary glide bracket 580. Typically, the glide bracket 580 and the carrier link 450 are moveably coupled by a plurality of intermediate glide links that allow for forward and rearward translation of the linkage mechanism 100 with respect to the underlying surface. In an exemplary embodiment, the pair of glide links include a rear glide link 560 and a front glide link 570. An upper end of the rear glide link 560 is pivotably coupled to the glide bracket 580 at pivot 586, while a lower end of the rear glide link 560 is pivotably coupled to the carrier link 450 at pivot 585. An upper end of the front glide link 570 is pivotably coupled to the glide bracket 580 at pivot 576, while a lower end of the front glide link 570 is pivotably coupled to the carrier link 450 at pivot 575. In operation, the rear glide link 560 and the front glide link 570 swing in concert to translate the carrier link 450 with respect to the glide bracket 580. Specifically, the pivots 575, 576, 585, and 586 are arranged to allow the rear glide link 560 and the front glide link 570 to sway in substantially parallel-spaced relation to each other; thus, facilitating the glide action of the linkage mechanism 100.

Turning now to FIGS. 5 and 8, the interconnecting links of the seat-adjustment assembly 500 will now be discussed. Initially, in embodiments, the seat-adjustment assembly 500 includes a motor bellcrank 430, a front lift link 440, a carrier link 450, a lifter link 460, the motor pivot bracket 470 (see FIG. 5), the back-mounting link 510, a rear pivot link 520, a rear link 530, a blocker control link 540, a sequence link 550, a hook link 565, and the footrest drive link 590. As discussed above, the footrest drive link 590 is pivotably coupled at the forward portion 591 to the rear ottoman link 120, of the footrest assembly 200, at the pivot 275. Further, the footrest drive link 590 is indirectly coupled to the glide assembly 600 via the blocker control link 540 and the hook link 565. That is, a rearward portion 592 of the footrest drive link 590 is pivotably coupled to an upper end 541 of the blocker control link 540 at pivot 545, while a lower end 542 of the blocker control link 540 is pivotably coupled to a back end of the hook link 565 at pivot 566 (see FIG. 6). A front end of the hook link 565 is rotatably coupled to a mid portion 451 of the carrier link 450 of the glide assembly at pivot 586.

In addition, the footrest drive link 590 is pivotably coupled at a back end 593 to the rear pivot link 520 at pivot 525. In an exemplary embodiment, the pivot 525 is coupled to a generally cylindrical sequence element 526 (e.g., bushing, disc, wheel, and the like) that extends, at least partially within a longitudinal guide slot (see reference numeral 551 of FIG. 8)

formed (e.g., laser cut or stamped) within a lower portion 554 of the sequence link 550. In one embodiment, the sequence element 526 is rollably or slidably engaged within the guide slot 551 and laterally captured between the footrest drive link 590 and the rear pivot link 520. Although various configurations of the assembly and interplay between the guide slot 551 and the sequence element 526 have been described, it should be understood and appreciated that other types of suitable mechanisms that allow longitudinal shifting of a pivot location between links may be used, and that embodiments of the present invention are not limited to the slot-and-element configuration described herein. For instance, the sequence element 526 and the guide slot 551 may be replaced by a track that guides a roller in a predefined trajectory in order to achieve sequencing of adjustment.

In instances of the present invention, the guide slot 551 represents a pill-shaped aperture formed within the lower portion 554 of the sequence link 550. Further, a central, longitudinal axis of the guide slot 551 may be substantially aligned with a central, longitudinal axis of the sequence link 550. In an exemplary embodiment, the sequence element 526 fully extends through the guide slot 551 such that the sequence element 526 substantially spans between the footrest drive link 590 and the rear pivot link 520, which laterally retain the sequence link 550 onto the sequence element 526. In operation, the guide slot 551 acts to guide in a predetermined trajectory and retain the sequence element 526 (see FIGS. 9-11). Further, the guide slot 551 of the sequence link 550 assists in ensuring the first phase and second phase of the linear-actuator stroke do not interfere with or overlap each other. Beyond being rollably or slidably engaged within the guide slot 551 of the sequence link 550 at the pivot 525, the rear pivot link 520 is rotatably coupled to the back-mounting link 510 at pivot 521. Similarly, an upper portion 553 of the sequence link 550 is rotatably coupled to the back-mounting link 510 at pivot 552. In an exemplary embodiment, the pivot 521 is rearward of the pivot 552, with respect to the glider recliner. Further, the pivot 552 is rearward of pivot 511, which rotatably couples a rearward portion 402 of the seat-mounting plate 400 to the back-mounting link 510. Further yet, the pivot 511 is rearward of pivot 515, which pivotably couples the back-mounting link 510 to a back end 442 of the front lift link 440, as discussed more fully below.

Turning now to FIGS. 5-8, a remainder of the seat-adjustment assembly 500 will now be described. As discussed above, the rear pivot link 520 is rotatably coupled to the back-mounting link 510 at pivot 521 and to the footrest drive link 590 at pivot 525. Additionally, the rear pivot link 520 is pivotably coupled to an upper end of the rear link 530 at pivot 522. A lower end of the rear link 530 is pivotably coupled to the carrier link 450 at pivot 535. In an exemplary embodiment, the pivot 535 is located rearward of the mid portion 451 of the carrier link 450. The carrier link 450 is further pivotably coupled to a front end 461 of the lifter link 460 at pivot 466, which is located forward of the mid portion 451. A back end 462 of the lifter link 460 is pivotably coupled to a second end 434 of the motor bellcrank 430 at pivot 465.

In an exemplary embodiment, the motor bellcrank 430 is an L-shaped link that includes a mid portion 433 located between a first end 432 and the second end 434. As mentioned above, the activator bar 350 is rotatably coupled to the first end 432 of the motor bellcrank 430 via the motor pivot bracket 470 of the motor assembly 300 at pivot 431. The front lift link 440 includes a front end 441 and a back end 442. In embodiments, the back end 442 of the front lift link 440 is pivotably coupled to the back-mounting link 510 at pivot 515. The front end 441 of the front lift link 440 is pivotably coupled to the carrier link 450 at pivot 445. The mid portion 433 of the motor bellcrank 430 is rotatably coupled to a section between the front end 441 and the back end 442 of the front lift link 440.

The back-mounting link 510 serves to support the backrest and is angled rearwardly to a reclined orientation when the linkage mechanism 100 is moved from the extended position to the reclined position. The back-mounting link 510 is pivotably coupled to the back end 442 of the front lift link 440 at the pivot 515, the upper portion 553 of the sequence link 550 at pivot 552, and the rear pivot link 520 at the pivot 521. Also, the back-mounting link 510 is rotatably coupled to the rearward portion 402 of the seat-mounting plate 400 at pivot 511. Further, the sequence link 550 is rotatably coupled to the back-mounting link 510 at the pivot 552 and, as discussed more fully above, includes a longitudinal slot (see reference numeral 551 of FIG. 8) that guides a trajectory of movement of the sequence element 526 connected to the pivot 525 of the rear pivot link 520.

The seat-mounting plate 400 serves to support the seat of the glider recliner. The seat-mounting plate 400 is situated in a substantially horizontal orientation when the linkage mechanism 100 resides in the closed position and the extended position. But, when the linkage mechanism 100 is adjusted to the reclined position, with the assistance of the linear actuator, the seat-mounting plate 400 is shifted upward and rotated slightly rearward, thereby orientating the seat in a slightly angled position. The seat-mounting plate 400 is pivotably coupled to the front ottoman link 110 and the rear ottoman link 120 of the footrest assembly 200 at the pivots 115 and 121, respectively. Also, the seat-mounting plate 400 is pivotably coupled to the back-mounting link 510 of the seat-adjustment assembly 500 at the pivot 511. As illustrated in the FIGS. 5-8, the locations of the pivots that interconnect the linkage mechanism 100 and the seat-mounting plate 400 are configured to translate the seat-mounting plate 400 at a substantially consistent inclination angle, with respect to the glide bracket 580, throughout the adjustment of the glider recliner between the closed position, the extended position, and the reclined position.

The operation of the seat-adjustment assembly 500 will now be discussed with reference to FIGS. 5-11. Initially, an occupant of the glider recliner may invoke an adjustment from the reclined position (FIGS. 3, 4, 5, 8, and 11) to the extended position (FIGS. 2, 6, and 10) in an effort to sit upright for viewing television. In an exemplary embodiment, the occupant may invoke an actuation at a hand-operated controller that sends a control signal with instructions to the linear actuator. As discussed above, the linear actuator moves in a sequenced manner, which is enforced by a weight of the occupant, a placement of springs within the seat-adjustment assembly 500, and/or a configuration of the sequence link 550 and sequence element 526. Typically, the movement of the linear actuator is sequenced into two substantially independent strokes: the first phase (adjusting between the closed and extended positions), and the second phase (adjusting between the extended and reclined positions).

Upon receiving the control signal from the hand-operated controller when the linkage mechanism 100 resides in the reclined position, the linear actuator carries out a stroke in the second phase. That is, with reference to FIG. 4, the linear actuator slides the motor activator block 340 forward with respect to the glide assembly 600 while holding the motor mechanism 320 relatively fixed in space. This sliding action of the motor activator block 340 pulls the activator bar 350 and the attached motor pivot bracket 470 forward. The forward force on the motor pivot bracket 470 creates a clockwise moment 705 (see FIG. 6) on the motor bellcrank 430 about the pivot 435 that pulls the front lift link 440 downward. This pulling action is caused, in part, by the rotation of the motor bellcrank 430 at the pivot 465, which pivotably couples the motor bellcrank 430 to the lifter link 460. The lifter link 460 is restrained from translational movement by its pivotable coupling to the carrier link 450 at the pivot 466 (see FIG. 8).

Further, the downward pulling action on the front lift link 440 creates a counter-clockwise moment 700 (see FIG. 6) of the back-mounting link 510 about the pivot 511, which rotatably couples the back-mounting link 510 to the seat-mounting plate 400. This moment 700 of the back-mounting link 510 inclines the attached seat and causes the sequence element 526, which is coupled to the rear pivot link 520 at the pivot 525, to slide in an upward trajectory within the longitudinal guide slot 551 of the sequence link 550. In an exemplary embodiment, the sequence element 526 slides from the second region 556 (see FIG. 11) to the first region 555 (see FIG. 10) of the guide slot 551. As discussed above, if the sequence element 526 resides within the second region 556 (when the glider recliner is adjusted to the reclined position), the interaction of the sequence element 526 and the sequence link 550 resists adjustment of the glider recliner directly from the reclined position to the closed position. Then, upon the back-mounting link 510 rotating to a position that causes contact between a rear stop 420 and the front lift link 440, the linkage mechanism 100 has achieved the extended position and the linear actuator has completed the stroke of the second phase.

The operation of the footrest assembly 200 will now be discussed with reference to FIGS. 6 and 7. As discussed above, when desiring to move from the extended position (FIG. 6) to the closed position (FIG. 7), the occupant may invoke an actuation at the hand-operated controller that sends the control signal with instructions to the linear actuator to carry out a stroke in the first phase. Upon receiving the control signal from the hand-operated controller, the linear actuator slides the motor mechanism 320 rearward with respect to the glide assembly 600 while holding the motor activator block 340 relatively fixed in space. This sliding action of the motor mechanism 320 pulls the front motor tube 310 and the attached front ottoman link 110 rearward. In an exemplary embodiment, the rearward force on the front ottoman link 110 removes the front ottoman link 110 from contact with a front stop 422, which serves to limit the extension of the footrest assembly 200.

Further, the rearward force on the front ottoman link 110 indirectly causes a rearward translation of the footrest drive link 590. This rearward translation of the footrest drive link 590 directly creates a counter-clockwise moment 710 of the rear pivot link 520 about the pivot 521, which rotatably couples the rear pivot link 520 to the back-mounting link 510. This moment 710 (see FIG. 7) functions to slide the sequence element 526 (coupled to the rear pivot link 520 at the pivot 525) in an downward trajectory within the longitudinal guide slot 551 of the sequence link 550.

In an exemplary embodiment of the first phase, the sequence element 526 slides from the first region 555 (see FIG. 10) to the second region 556 (see FIG. 9) of the guide slot 551. As discussed above, if the sequence element 526 resides within the first region 555 (when the glider recliner is adjusted to the extended position), the interaction of the sequence element 526 and the sequence link 550 allows adjustment of the glider recliner to either the reclined position or to the closed position. However, upon adjusting the glider recliner to the closed position, the sequence element 526 resides within the second region 556 (see FIG. 9) and the interaction of the sequence element 526 and the sequence link 550 resists adjustment of the glider reclined directly from the closed position to the reclined position. Further, the movement 710 functions to slightly lift upward and tilt forward the back-mounting link 510. This forward tilt of the back-mounting link 510 pulls the front lift link 440 downward at the pivot 515. Once the front lift link 440 is pulled downward to a position where it makes contact with a mid stop 421, the linkage mechanism 100 has achieved the closed position.

In a manner that is reverse to the steps discussed above, with reference to operation of the footrest assembly 200 from the closed position to the extended position, the automated force of the motor mechanism 320 on the front motor tube 310 in the first phase of the linear-actuator stroke rotates the front ottoman link 110 about the pivot 115. This rotation acts to extend the footrest assembly 200 and causes the links 110, 120, 130, and 150 to move upwardly and/or rotate in a clockwise direction. Also, the brackets 140 and 170 are raised and rotated in a clockwise fashion such that the ottomans 45 and 47 (see FIGS. 1-3) are adjusted from a collapsed, generally vertical orientation to an extended, generally horizontal orientation. Extension of the footrest assembly is restrained upon the front ottoman link 110 coming into contact with the front stop 422.

In addition, upon completion of the first phase, continued actuation of the linear actuator causes the adjustment of the linkage mechanism 100 within the second phase of the linear-actuator stroke. Within the second phase, the automated force of the motor activator block 340 on the activator bar 350 rotates the motor bellcrank 430 in a counter-clockwise direction about the pivot 435 (with respect to FIGS. 5-7), which acts to raise the front lift link 440 and, in turn, bias rearward the back-mounting link 510 via the pivot 515. The rearward bias of the back-mounting link 510, as well as continued adjustment within the second phase, is restrained upon the completion of the stroke within the second phase.

It should be understood that the construction of the linkage mechanism 100 lends itself to enable the various links and brackets to be easily assembled and disassembled from the remaining components of the glider recliner. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit having a chassis, a seat, a backrest, and at least one foot-support ottoman, the seating unit being adapted to move between a closed, an extended and a reclined position, the seating unit comprising:

a pair of glide brackets in substantially parallel-spaced relation, wherein the glide brackets are mounted to the chassis and are vertically raised above an underlying surface by a plurality of supports;

a pair of seat-mounting plates in substantially parallel-spaced relation, wherein the seat-mounting plates translatably carry the seat over the glide brackets; and a pair of the generally mirror-image linkage mechanisms each moveably interconnecting each of the glide brackets to a respective seat-mounting plate, wherein each of the linkage mechanisms comprise:

(a) a footrest assembly that extends and retracts the at least one foot-support ottoman, wherein the footrest assembly includes a front ottoman link that is rotatably coupled to a forward portion of one of the seat-mounting plates; and (b) a seat-adjustment assembly that reclines and inclines the backrest; and a front motor tube that spans and couples to the pair of linkage mechanisms, wherein the front motor tube having a pair of ends, wherein one of the ends of the front motor tube is fixedly coupled to the front ottoman link;

a linear actuator that provides automated adjustment of the seating unit between a closed position, an extended position, and a reclined position, wherein the linear actuator is pivotably coupled to the front motor tube, wherein the linear-actuator adjustment is sequenced into a first phase and a second phase that are mutually exclusive in stroke, wherein the first phase moves the footrest assembly between the closed position and the extended position upon the linear actuator exerting lateral thrust onto the front motor tube that, in turn, invokes movement of the front ottoman link, wherein the movement of the first ottoman link controls adjustment of the footrest assembly between the closed position and the extended position, and wherein the second phase moves the seat-adjustment assembly between the extended position and the reclined position.

2. The seating unit of claim 1, further comprising an activator bar that spans and couples to the pair of linkage mechanisms.

3. The seating unit of claim 2, wherein the linear actuator comprises:

a motor mechanism;

a track operably coupled to the motor mechanism, wherein the track includes a first travel section and a second travel section; and a motor activator block that translates longitudinally along the track under automated control.

4. The seating unit of claim 3, wherein a housing of the motor mechanism is pivotably coupled to a section between the pair of ends of the front motor tube.

5. The seating unit of claim 4, wherein the first phase involves longitudinal translation of the motor activator block along the first travel section that creates a lateral thrust at the front motor tube.

6. The seating unit of claim 5, wherein, during the stroke of the linear actuator within the first phase, the motor mechanism moves forward and upward with respect to the pair of glide brackets while the motor activator block remains generally fixed in space.

7. The seating unit of claim 3, wherein the activator bar having a pair of ends, wherein one of the ends of the activator bar is rotatably coupled to a motor bellcrank within the seat-adjustment assembly.

8. The seating unit of claim 7, wherein the seat-adjustment assembly comprises:

the motor bellcrank that includes a mid portion located between a first end and a second end, wherein the activator bar is rotatably coupled to the first end of the motor bellcrank;

a back-mounting link rotatably coupled to a respective seat-mounting plate, wherein the back-mounting link is configured to support the backrest; and a front lift link having a front end and a back end, wherein the back end of the front lift link is pivotably coupled to the back-mounting link, and wherein the mid portion of the motor bellcrank is rotatably coupled to a section between the front end and the back end of the front lift link.

9. The seating unit of claim 8, wherein the motor activator block is fixedly coupled to a section between the pair of ends of the activator bar.

10. The seating unit of claim 9, wherein the second phase involves longitudinal translation of the motor activator block along the second travel section that creates a lateral thrust at the activator bar, thereby invoking movement of the motor bellcrank, the movement of the motor bellcrank controls adjustment of the seat-adjustment assembly between the extended position and the reclined position.

11. The seating unit of claim 10, wherein, during the stroke of the linear actuator within the second phase, the motor activator block moves rearward with respect to the pair of glide brackets while the motor mechanism remains generally fixed in space.

12. The seating unit of claim 11, wherein each of the linkage mechanisms further comprise a glide assembly that includes a pair of glide links that swing in concert to translate a carrier link of the seat-adjustment assembly forward and backward with respect to one of the pair of glide brackets.

13. The seating unit of claim 12, wherein the pair of linkage mechanisms are configured to translate the seat-mounting plates at a substantially consistent inclination angle, with respect to the glide brackets, throughout the adjustment of the seating unit between the closed position, the extended position, and the reclined position.

14. The seating unit of claim 13, wherein the seat-adjustment assembly further comprises a lifter link that pivotably interconnects the second end of the motor bellcrank and the carrier link.

15. A pair of the generally mirror-image linkage mechanisms adapted to move a seating unit between a closed, an extended, and a reclined position, the seating unit having a chassis, a seat that is translatable with respect to the chassis, and a backrest that is angularly adjustable with respect to the seat, each of the linkage mechanisms comprising:

a sequence link having a guide slot, wherein the guide slot represents a aperture formed within the sequence link, and wherein the guide slot includes a first region and a second region; and a sequence element that, at least partially, extends into the guide slot, wherein the sequence element resides within the second region when the seating unit is adjusted to the reclined position, and when the seating unit is adjusted to the reclined position, the interaction of the sequence element and the sequence link resists adjustment of the seating unit to the closed position, wherein the sequence element resides within the first region when the seating unit is adjusted to the extended position, and when the seating unit is adjusted to the extended position, the interaction of the sequence element and the sequence link allows adjustment of the seating unit to either the reclined position or to the closed position, and wherein the sequence element resides within the second region when the seating unit is adjusted to the closed position, and when the seating unit is adjusted to the closed position, the interaction of the sequence element and the sequence link resists adjustment of the seating unit to the reclined position.

16. The linkage mechanism of claim 15, further comprising a back-mounting link that is configured to support the backrest, wherein the sequence link includes an upper portion and a lower portion, and wherein the upper portion is rotatably coupled to the back-mounting bracket.

17. The linkage mechanism of claim 16, wherein the sequence element fully extends through the guide slot, wherein the sequence element includes a cap that retains the sequence link onto the sequence element, and wherein the first region is above the second region within the guide slot.

18. The linkage mechanism of claim 17, further comprising:

a seat-mounting plate that supports the seat, the seat-mounting plate rotatably coupled to the back-mounting link;

a glide bracket fixedly mounted to the chassis, the glide bracket pivotably coupled to a pair of glide links that swing in concert to translate the seat-mounting plate forward and backward with respect to the glide bracket;

a rear pivot link rotatably coupled to the back-mounting link, wherein the rear pivot link is rotatably coupled to the sequence element.

19. A seating unit, comprising:

a pair of glide brackets in substantially parallel-spaced relation, wherein the glide brackets are rigidly supported above an underlying surface;

a pair of seat-mounting plates in substantially parallel-spaced relation, wherein each of the seat-mounting plates is disposed in an inclined orientation in relation to each of the glide brackets, respectively;

a pair of generally mirror-image linkage mechanisms each moveably interconnecting each of the seat-mounting plates to a respective glide bracket, and adapted to move the seating unit between a closed position, an extended position, and a reclined position, wherein each of the linkage mechanisms comprise:

(a) a back-mounting link rotatably coupled to a respective seat-mounting plate and configured to support a backrest of the seating unit;

(b) a sequence link rotatably coupled to the back-mounting link, wherein the sequence link includes a guide slot;

(c) a rear pivot link rotatably coupled to the back-mounting link at a pivot location rearward of the sequence link, wherein the rear pivot link is rotatably coupled to the sequence element, wherein the sequence element extends into the guide slot, and wherein interaction between the sequence element and the sequence link resists direct adjustment between the closed position and the reclined position;

(d) a motor bellcrank having a mid portion located between a first end and a second end, wherein an activator bar is rotatably coupled to the first end of the motor bellcrank; and (e) a front lift link having a front end and a back end, wherein the back end of the front lift link is pivotably coupled to the back-mounting link, and wherein the mid portion of the motor bellcrank is rotatably coupled to a section between the front end and the back end of the front lift link; and a linear actuator, coupled to the activator bar, that is sequenced into a mutually exclusive first phase and second phase, wherein the first phase moves the linkage mechanisms between the closed position and the extended position, and wherein the second phase moves the linkage mechanisms between the extended position and the reclined position.

* * * * *